US007615095B2

(12) United States Patent
Margaria

(10) Patent No.: US 7,615,095 B2
(45) Date of Patent: Nov. 10, 2009

(54) PRODUCTS FOR THE PROTECTION OF CONTINUOUS CAST MOULDS FOR CAST-IRON PIPES

(75) Inventor: Thomas Margaria, Chambery (FR)

(73) Assignee: Pechiney Electrometallurgie, Chambery (FR)

( * ) Notice: Subject to any disclaimer, the term of this patent is extended or adjusted under 35 U.S.C. 154(b) by 794 days.

(21) Appl. No.: 10/500,474

(22) PCT Filed: Jan. 21, 2003

(86) PCT No.: PCT/FR03/00181

§ 371 (c)(1),
(2), (4) Date: Aug. 9, 2004

(87) PCT Pub. No.: WO03/061878

PCT Pub. Date: Jul. 31, 2003

(65) Prior Publication Data

US 2005/0066771 A1 Mar. 31, 2005

(30) Foreign Application Priority Data

Jan. 25, 2002 (FR) ..... 02 00947

(51) Int. Cl.
*B22F 1/00* (2006.01)
*B22C 3/00* (2006.01)

(52) U.S. Cl. ..... 75/252; 75/305; 75/309; 164/72; 164/138; 106/38.27

(58) Field of Classification Search ..... 75/305, 75/309; 106/38.22, 38.27; 164/72, 138
See application file for complete search history.

(56) References Cited

U.S. PATENT DOCUMENTS

| | | | | | |
|---|---|---|---|---|---|
| 1,982,763 | A | * | 12/1934 | Russell et al. | 164/72 |
| 2,152,717 | A | * | 4/1939 | Wehmeier et al. | 164/59.1 |
| 2,245,994 | A | * | 6/1941 | Mcwane | 164/117 |
| 3,415,307 | A | * | 12/1968 | Schuh et al. | 420/22 |
| 3,588,028 | A | * | 6/1971 | Okamoto et al. | 249/116 |
| 3,746,078 | A | * | 7/1973 | Moore et al. | 164/363 |
| 4,058,153 | A | * | 11/1977 | Pierrel | 164/58.1 |
| 4,313,758 | A | * | 2/1982 | Henning et al. | 420/21 |
| 5,033,531 | A | * | 7/1991 | Fisher et al. | 164/57.1 |
| 5,193,604 | A | | 3/1993 | Brugger | |
| 5,249,619 | A | | 10/1993 | Meacock, II et al. | |
| 6,338,753 | B1 | * | 1/2002 | Margaria et al. | 106/38.22 |

FOREIGN PATENT DOCUMENTS

| | | |
|---|---|---|
| FR | 2612097 | 9/1988 |
| GB | 930391 | 7/1963 |
| JP | 56099061 | 10/1981 |
| JP | 09/271922 | 10/1997 |
| JP | 11277210 | * 10/1999 |

* cited by examiner

*Primary Examiner*—Roy King
*Assistant Examiner*—Ngoclan T Mai
(74) *Attorney, Agent, or Firm*—Dennison, Schultz & MacDonald

(57) ABSTRACT

A powder product for the protection of centrifugal casting molds for cast iron pipes includes an inoculating metal alloy and possibly mineral powders, and a strongly reducing metal that is volatile at the temperature of the liquid cast iron. The use of products according to the invention prevents accumulation of dirt on molds and improves the surface condition of the cast iron pipes.

21 Claims, No Drawings

PRODUCTS FOR THE PROTECTION OF CONTINUOUS CAST MOULDS FOR CAST-IRON PIPES

This application is a filing under 35 USC 371 of PCT/FR2003/000181 filed Jan. 21, 2003.

FIELD OF THE INVENTION

The invention relates to a powder product designed to protect casting moulds for cast iron pipes made by centrifugal casting; the casting moulds used are commonly referred to as "shells".

STATE OF THE ART

Coatings used for protection of centrifugal casting shells for cast iron pipes were composed firstly of inoculation products and powder refractory materials, and mixes of silica and bentonite placed by spraying of an aqueous solution. For example, this type of coating is described in Pont-à-Mousson's U.S. Pat. No. 4,058,153.

These products were subsequently replaced by dry spray powders sprayed on the shell before the cast iron was moulded, using the technique referred to as "dry spray". Regardless of the technique used for their placement, these products are used to create a thermal barrier effect limiting the temperature rise of the shell and thus contributing to increasing its life, and also an inoculating effect on the poured cast iron to control the metallurgical structure of the pipe.

It is well known that insufficient inoculation will lead to the formation of carbide in the cast iron, high shrinkage during cooling and fast mould stripping, which helps to increase productivity. But the parts thus obtained will require subsequent heat treatment that may be expensive.

Depending on the case, it may be preferred to inoculate more to prevent the final heat treatment even though the production rate is lowered, or on the other hand to inoculate only slightly to increase productivity and then apply heat treatment to the cast iron part.

Therefore, the inoculating power of the dry spray may vary within fairly wide limits, however other effects requested from the product are subjected to more constant requirements.

Therefore, dry spray products are usually composed of a mix of several components, including an inoculant with a variable efficiency that may form 30 to 100% of the product, for example a ferro-silicon containing 0.1 to 3% of aluminium and calcium and an inert mineral filler, for example silica or fluorspar that may form between 0 to 70% of the product.

Patent FR 2612097 (Foseco) describes the use of FeSiMg type alloys as treatment agents, with particles electrically charged by friction.

These mixes are in the form of powders with size grading always smaller than 400 μm, but free of fines. For example, a size grading of between 50 and 200 μm is well adapted.

PURPOSE OF THE INVENTION

The purpose of the invention is a powder product for the protection of centrifugal casting moulds for cast iron pipes, comprising an inoculating metal alloy and possibly inert mineral powders and a highly reducing metal that is volatile at the temperature of the liquid cast iron.

DESCRIPTION OF THE INVENTION

Products according to prior art used as dry spray for the manufacture of cast iron pipes by centrifugal casting have some disadvantages. The inert mineral filler added to the mix contributes to increasing the risks of making moulds dirty and the formation of inert mineral inclusions in the cast iron that can appear as surface defects on the pipes.

Furthermore, the applicant has observed that although the addition of a strongly reducing agent such as aluminium protects the shells and their life, in some cases, it can increase the risk of occurrence of unacceptable pitting defects on the surface of the pipes.

Therefore, the applicant's objective was to develop products that protect the user from these disadvantages. These products comprise an inoculating alloy, for example based on ferro-silicon, or a mix of inoculating alloys, possibly a mineral filler and a reducing agent with a content of between 0.3 and 18%, composed of a metal that is volatile at the temperature of the liquid cast iron, that may be a metal from column 2 in the Mendeleiev classification, and preferably a metal from column 2a in the periodic table of the elements. The preferred metals are calcium or magnesium or alloys containing at least one of these metals. Silicon alloys are particularly suitable, particularly the CaSi alloys. Thus, the following alloy compositions can be used (by weight):

Si 58-65%; Ca 27-35%; Fe 2-7%; Al 0.4-2%.

The product preferably contains,

- either between 0.3 and 4% by weight of magnesium, and preferably between 0.5 and 2%. It is found that the casting mould starts to get dirty in the form of whitish traces of MgO if the content is higher than 4%.
- or 15 to 40% by weight of CaSi alloy, representing a calcium content of between 4 and 14%.

Tests carried out by the applicant have shown that ferrous alloys of the FeSiCa type, typically containing more than 10% iron and frequently called "CaSiFer" containing (by weight):

Si 51-58%; Ca 16-20%; Fe 23-27%; Al 0.3-1.5% and FeSiMg type alloys containing (by weight):

Si 47-53%; Fe 35-48%; Mg 2-12%; Al 0.2-1.5%; Ca 0.1-1.5%, rare earths 0-2%, give disappointing results, well below the results obtained with mixes according to the invention.

The corresponding quantities of the different constituents in the final mix were evaluated as a function of the defects that can arise as a result of overdoses.

Furthermore, for safety reasons related to preparation of the products, the reducing metals or reducing alloys are not used alone, but rather in the form of a premix with an inert substance, preferably calcium fluoride, magnesium fluoride or a mix of these two fluorides. For maximum efficiency, the strongly reducing metal alloy content in the premix is preferably between 15 and 60%.

The size grading of the products is less than 400 μm, and is preferably less than 250 μm. Fine particles smaller than 40 μm and preferably smaller than 50 μm are excluded to prevent dust emission during use.

EXAMPLES

Example No. 1

A mix was prepared according to prior art with the following constituents:

85% ferro-silicon with 75.2% of Si, 1.3% of Ca and 0.45% of Al, with size grading of between 50 and 200 μm and 15% of fluorspar with a size grading of between 10 and 150 μm.

This product gave satisfactory results when used as a dry spray as a reference test; the pipes were stripped after 55 seconds of cooling and the thickness of ferritic cast iron measured on pipes made in this way was 35 microns. However, the shells were slightly attacked.

Example No. 2

A mix according to the invention was prepared from the following constituents:

55% ferro-silicon with 75.2% of Si, 1.3% of Ca and 0.45% of Al with size grading between 50 and 200 μm and 45% of a mix composed of ⅓ fluorspar between 10 and 150 μm, and ⅔ of calcium silicide with 60.1% of Si, 31.7% of Ca and 4.3% of Fe.

When used as a dry spray this product gave satisfactory results; the pipes were stripped after 45 seconds cooling and a thickness of 25 μm of ferritic cast iron was measured on the pipes made in this way. However, there was no visible attack of the shells.

Therefore, this type of product gives better results than the product mentioned in example No. 1.

Example No. 3

A mix of 50% of magnesium powder with size grading between 50 and 250 μm, 25% of magnesium fluoride with size grading between 40 and 250 μm, and 25% fluorspar with size grading between 40 and 250 μm, was prepared.

A mix according to the invention was then prepared consisting of 3% of the previous mix and 97% of ferro-silicon with 75.2% of Si, 1.3% of Ca and 0.45% of Al with a size grading between 50 and 200 μm.

When used as dry spray test, this product gave results considered to be better than those obtained in examples No. 1 and No. 2; the pipes were stripped after 37 seconds cooling and the pipes thus made were found to have a ferritic cast iron thickness of 30 μm. The surface condition of the parts was considered to be excellent.

Example No. 4

A mix according to prior art was prepared with an equivalent composition of the mix in example 3, composed (by weight) as follows:

- 43% of ferro-silicon with 75.2% of Si, 1.3% of Ca and 0.45% of Al with size grading between 50 and 200 μm and originating from the same batch as the ferro-silicon used in the previous example.
- 29.5% of a FeSiMg type alloy with size grading between 50 and 200 μm, analysed to contain 50.7% of Si, 42.0% of iron, 5.2% of Mg, 1.2% of Ca and 0.35% of Al,
- 26% of metallurgical silicon powder with size grading between 50 and 200 μm containing 98.6% of Si.
- 0.75% of magnesium fluoride with size grading between 40 and 250 μm,
- 0.75% of fluorspar with size grading between 40 and 250 μm.

When used as a dry spray, this product gave results significantly worse than those obtained in example 3. Pipes were stripped after 50 seconds cooling, the observed thickness of ferritic cast iron on the pipes thus made was 35 μm, and absolutely unacceptable pitting was observed on the surface of the parts with a density of the order of 25 per $m^2$.

The invention claimed is:

1. Powder product for the protection of centrifugal casting molds used for the manufacture of cast iron pipes, comprising a mixture of:

at least one inoculating alloy;

at least one strongly reducing metal that is volatile at the temperature of liquid cast iron, the at least one strongly reducing metal being in the form of at least one non-ferrous alloy, and being present in an amount of 0.3 to 18% by weight of the product; and optionally inert mineral powder.

2. Product according to claim 1, wherein the at least one inoculating alloy comprises a mixture of a plurality of inoculating alloys.

3. Powder product for the protection of centrifugal casting molds used for the manufacture of cast iron pipes, comprising a mixture of:

at least one inoculating alloy;

at least one strongly reducing metal that is volatile at the temperature of liquid cast iron; and optionally inert mineral powder, wherein the at least one strongly reducing metal comprises magnesium present in an amount of between 0.5 and 2% by weight of the powder product.

4. Product according to claim 1, wherein the at least one non-ferrous alloy contains less than 10% by weight of Fe.

5. Product according to claim 4, wherein the at least one non-ferrous alloy is an SiCa alloy containing, by weight:

Si 58-65%; Ca 27-35%; Fe 2-7%; Al 0.4-2%.

6. Product according to claim 5, containing between 15 and 40% by weight of said SiCa alloy.

7. Powder product for the protection of centrifugal casting molds used for the manufacture of cast iron pipes, comprising a mixture of:

at least one inoculating alloy;

at least one strongly reducing metal that is volatile at the temperature of liquid cast iron; and between 0.2and 15% by weight of an inert mineral powder.

8. Product according to claim 7, wherein the inert mineral powder is selected from the group consisting of calcium fluoride, magnesium fluoride and mixtures thereof.

9. Process for manufacturing a powder product for the protection of centrifugal casting molds used for the manufacture of cast iron pipes, comprising at least one inoculating alloy, at least one strongly reducing metal that is volatile at the temperature of liquid cast iron and inert mineral powder, comprising forming a powder premix of the at least one strongly reducing metal and the inert mineral powder, and mixing the powder premix with the at least one inoculating alloy in powder form, wherein the at least one strongly reducing metal constitutes 15 to 60% by weight of the premix.

10. In a process for molding cast iron comprising bringing molten cast iron into contact with an inside surface of a centrifugal casting mold, the improvement comprising protecting the mold by applying to the inside surface a powder product comprising at least one inoculating alloy and at least one strongly reducing metal that is volatile at the temperature of the molten cast iron, before bringing the molten cast iron into contact with the inside surface of the mold, the at least one strongly reducing metal being present in an amount of 0.3 to 18% by weight of the product.

11. Process according to claim 10, wherein the at least one inoculating alloy comprises a mixture of a plurality of inoculating alloys.

12. Process according to claim 10, wherein the at least one strongly reducing metal is an element in column II of the periodic table of elements.

13. Process according to claim 12, wherein the at least one strongly reducing metal is an element in subgroup IIa of the periodic table of elements.

14. Process according to claim 13, wherein the at least one strongly reducing metal is magnesium or calcium.

15. Process according to claim 14, wherein the product contains between 0.5 and 2% by weight of magnesium.

16. Process according to claim 10, wherein the product additionally comprises between 0.2 and 15% by weight of an inert mineral powder.

17. Process according to claim 16, wherein the inert mineral powder is selected from the group consisting of calcium fluoride, magnesium fluoride and mixtures thereof.

18. In a process for molding cast iron comprising bringing molten cast iron into contact with an inside surface of a centrifugal casting mold, the improvement comprising protecting the mold by applying to the inside surface a powder product comprising at least one inoculating alloy and at least one strongly reducing metal that is volatile at the temperature of the molten cast iron, before bringing the molten cast iron into contact with the inside surface of the mold, the at least one strongly reducing metal being added in the form of at least one non-ferrous alloy which is an SiCa alloy containing, by weight:

Si 58-65%; Ca 27-35%; Fe 2-7%; Al 0.4-2%.

19. Process according to claim 18, wherein the product contains between 15 and 40% by weight of said SiCa alloy.

20. Powder product for the protection of centrifugal casting molds used for the manufacture of cast iron pipes, comprising a mixture of:

at least one inoculating alloy;

at least one strongly reducing metal that is volatile at the temperature of liquid cast iron, the at least, one strongly reducing metal being in the form of at least one non-ferrous alloy; and optionally inert mineral powder, wherein the at least one non-ferrous alloy is an SiCa alloy containing, by weight:

Si 58-65%; Ca 27-35%; Fe 2-7%; Al 0.4-2%.

21. Product according to claim 20, containing between 15 and 40% by weight of said SiCa alloy.

* * * * *